United States Patent [19]

Dyrhood et al.

[11] Patent Number: 4,909,399

[45] Date of Patent: Mar. 20, 1990

[54] ADJUSTABLE MODULAR TICKET RACK

[75] Inventors: Julian R. Dyrhood; James D. Walcott, Jr., both of Ft. Smith, Ark.

[73] Assignee: Weldon, Williams and Lick, Inc., Fort Smith, Ark.

[21] Appl. No.: 370,127

[22] Filed: Jun. 21, 1989

Related U.S. Application Data

[63] Continuation of Ser. No. 191,429, May 9, 1988, abandoned, which is a continuation-in-part of Ser. No. 718,298, Apr. 1, 1985, D 295,934.

[51] Int. Cl.[4] ..... A47B 63/00

[52] U.S. Cl. ..... 211/55; 211/184; 211/10

[58] Field of Search ..... 211/184, 55, 128, 44, 211/194, 126, 10; 312/108, 257 R, 263, 111; 206/39; 220/22.1, 22; D6/468, 478, 571

[56] References Cited

U.S. PATENT DOCUMENTS

| | | | |
|---|---|---|---|
| D. 232,887 | 9/1974 | Funahashi | D6/571 |
| D. 238,535 | 1/1976 | Daniels | D6/468 |
| D. 255,300 | 6/1980 | Charles | D6/571 |
| D. 295,934 | 5/1988 | Dyrhood | D6/468 |
| 918,186 | 4/1909 | Morse | 211/55 |
| 1,276,781 | 8/1918 | Lynds | 211/184 |
| 2,985,333 | 5/1961 | Kirkman | 220/22 |
| 3,269,788 | 8/1966 | Kneer | 211/10 |
| 3,401,993 | 9/1968 | Fenkel | 312/111 |
| 3,703,326 | 11/1972 | Riviers | 312/111 |
| 3,977,742 | 8/1976 | Rovere | D6/478 |
| 4,728,158 | 3/1988 | D'Elia | 312/257 R |

FOREIGN PATENT DOCUMENTS

| | | | |
|---|---|---|---|
| 2216916 | 10/1972 | Fed. Rep. of Germany | 312/263 |
| 1544144 | 9/1968 | France | 312/111 |
| 77376 | 1/1955 | Netherlands | 211/135 |

*Primary Examiner*—Ramon O. Ramirez
*Assistant Examiner*—Robert A. Olson
*Attorney, Agent, or Firm*—Robert R. Keegan

[57] ABSTRACT

There is disclosed a ticket rack for tickets to performances or sports events in a readily accessible manner which is modular in form so that the modules can be arranged together providing many individual compartments for respective rows, sections or the like of theaters or arenas. The compartments are arranged in rows and columns similar to office desk pigeonholes, but are obliquely oriented for greater convenience, and a particular feature of the apparatus provides removable vertical dividers or partitions between certain of the compartment columns whereby their widths may be adjusted to accommodate two or more different widths of admission tickets. Thus the racks may not only be combined in a manner to best facilitate selection of particular tickets in a particular theater or arena, but also each rack module may be adjusted for different sizes of tickets by rearranging the removable partitions.

11 Claims, 2 Drawing Sheets

ADJUSTABLE MODULAR TICKET RACK

This application is a continuation of application Ser. No. 07/191,429, filed 5/9/88, now abandoned, which is a continuation-in-part of co-pending application Ser. No. 718,298, filed Apr. 1, 1985, for "MODULAR TICKET RACK" now patent Des. 295,934 granted May 31, 1988.

The present invention relates to ticket racks of the sort used at ticket windows of theaters or arenas facilitating the arrangement of groups of tickets for respective sections of the arena or theater so that the ticket vendor can readily locate the available tickets in a desired location. The problem of keeping numerous tickets conveniently arranged by location has previously been approached with built-in ticket racks next to ticket windows, or by the use of drawers or boxes specifically intended for the purpose. Also, ticket racks have been constructed of corrugated paperboard which allowed them to be moved and arranged within a ticket booth in a flexible manner, but racks of paperboard lack durability and ruggedness.

According to the present invention, a molded plastic ticket rack is provided which is of a convenient size about one foot square, and which forms a module to be connected together with other smaller modules to provide a rack with whatever number of compartments is needed.

A preferred embodiment of the ticket rack module has compartments or pigeonholes in an approximately square array of six rows by six columns. This embodiment is particularly adapted for tickets about one and one-half inches wide and about four inches long. The rack is constructed so that the compartment or pigeonhole slopes down sharply to the closed back end. The depth of the compartments or pigeonholes is less than four inches so that the ends of the tickets are visible as they extend out of the compartment opening. Normally the compartments slope upward from back to front, but the racks may also be placed on one side or the other with the tickets extending sideward out of the compartment opening rather than upward.

In the normal upright position the ticket rack modules have tongue and groove connector elements on the oblique top and bottom surfaces so that two or more such racks can be connected to form a vertically taller array. Assembled vertical arrays can, of course, be placed or fastened side by side for increased width to the extent space is available.

A notable feature of apparatus according to the present invention is a provision for removable dividers separating certain of the compartments in the rack. These may take the form of a divider in the shape of a parallelogram sliding into slotted tracks in the permanent horizontal dividers of the rack. In the preferred embodiment certain of the dividers may be moved or removed so that a module has four columns of tickets rather than six columns of tickets, and tickets widths of two and one-half inches rather than one and one-half inches are accommodated.

In addition to providing the above features and advantages it is an object of the present invention to provide a modular ticket rack having compartments with oblique top and bottom walls having slotted tracks therein to accommodate removable vertical dividers allowing the rack to be rearranged to accommodate tickets of different widths.

It is another object of the present invention to provide such a modular ticket rack with at least one vertical divider molded integrally with the rack and which is not movable.

It is still another object of the present invention to provide a modular ticket rack with tongue and groove connectors for conveniently securing modules of the rack together, and wherein slotted tracks are provided for dividers to optionally divide the width of the rack into quarters or into sixths to accommodate tickets of two different widths.

Other objects and advantages of the invention will be apparent from consideration of the appended drawings in conjunction with the following description in which.

Figure 1:
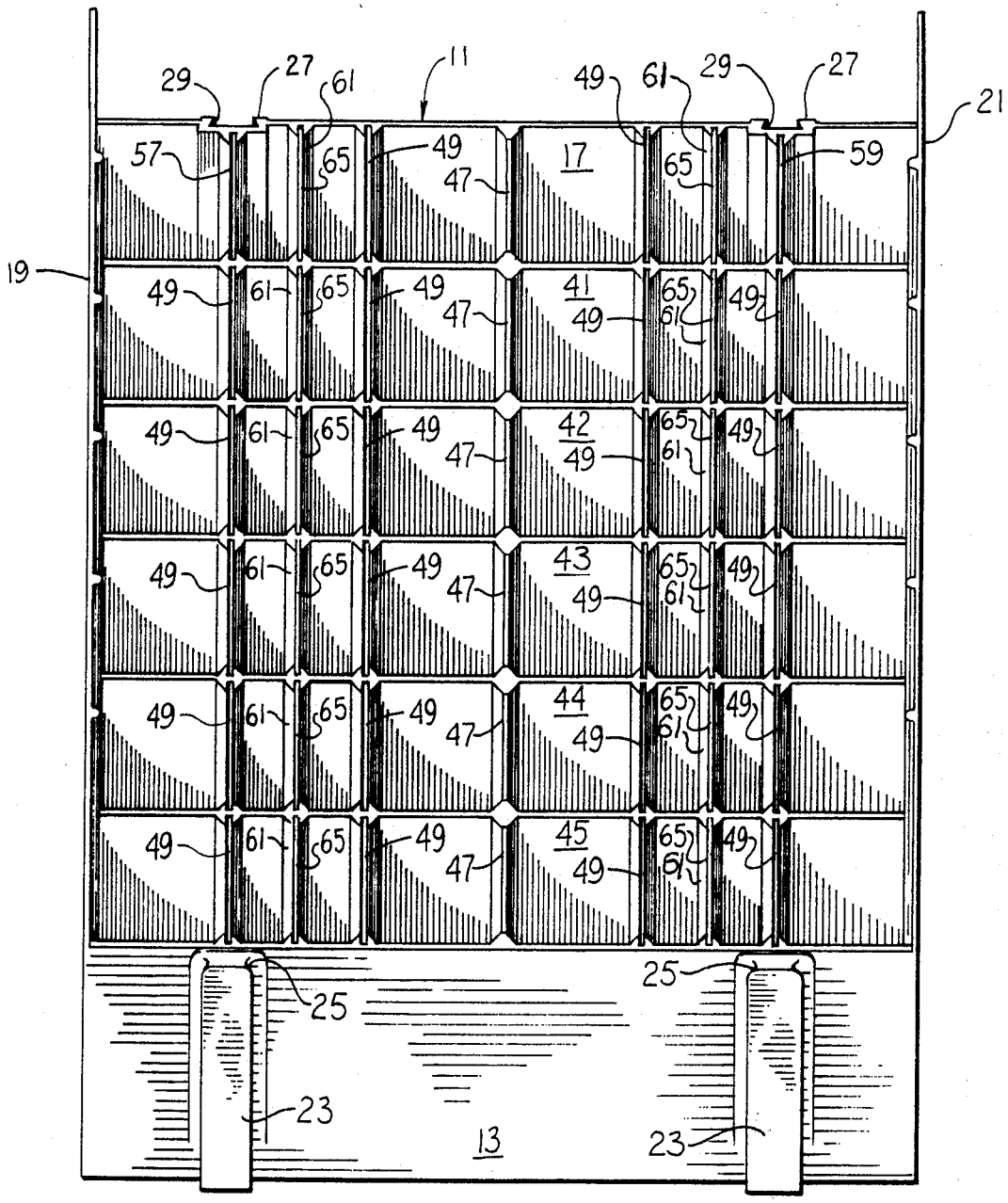
FIG. 1 is a front elevational view of an adjustable modular ticket rack according to the invention.
Figure 2:
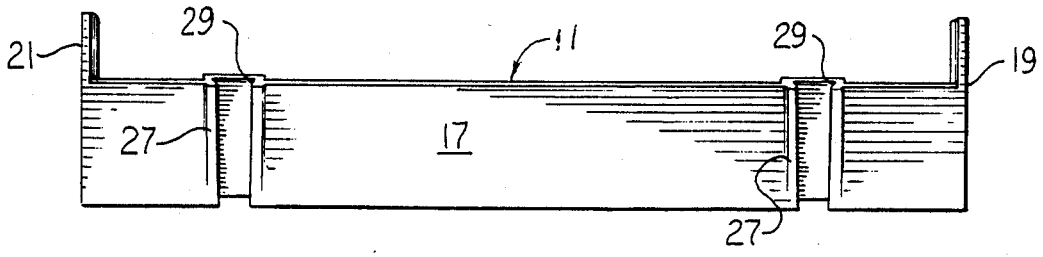
FIG. 2 is a top plan view thereof.

Referring now to the drawings, and particularly to FIG. 1 and 2, a modular ticket rack 11 is shown which is preferably formed by molding in one piece out of a suitable rigid or semi-rigid plastic such as Lexan, ABS, PVC, Nylon, polystyrene, polyacrylates, vinyl acetate, vinyl chloride, polyester resins, vinyl resins, vulcanized elastomers, phenolic resins or the like. The basic structure of the rack 11 is boxlike with a bottom 13, top 17, and sides 19 and 21. The back 15 is seen in FIG. 3.

The bottom 13 and the top 17 are obliquely oriented and may form an angle of about 30°, for example, with the back 15. It should be understood that reference to top, bottom, sides, etc. refers to the orientation of the rack 11 shown in FIG. 1. This will also be a common orientation of the rack in use, but it could also be arranged to rest on side 19 or side 21 if that is convenient in particular circumstances. Also, it might be arranged to rest on back 15.

It is contemplated that a plurality of ticket rack modules 11 will be used together to supply a large number of compartments and that, in many instances, two or more ticket rack modules 11 will be vertically stacked. To facilitate such an arrangement tongue connectors 23 are provided on bottom 13 and groove connectors 27 are provided on top 17. A recess 25 in each tongue connector 23 cooperates with the dovetail groove 29 in groove connector 27 so that two or more ticket rack modules 11 may be secured in a vertical array.

Figure 3:
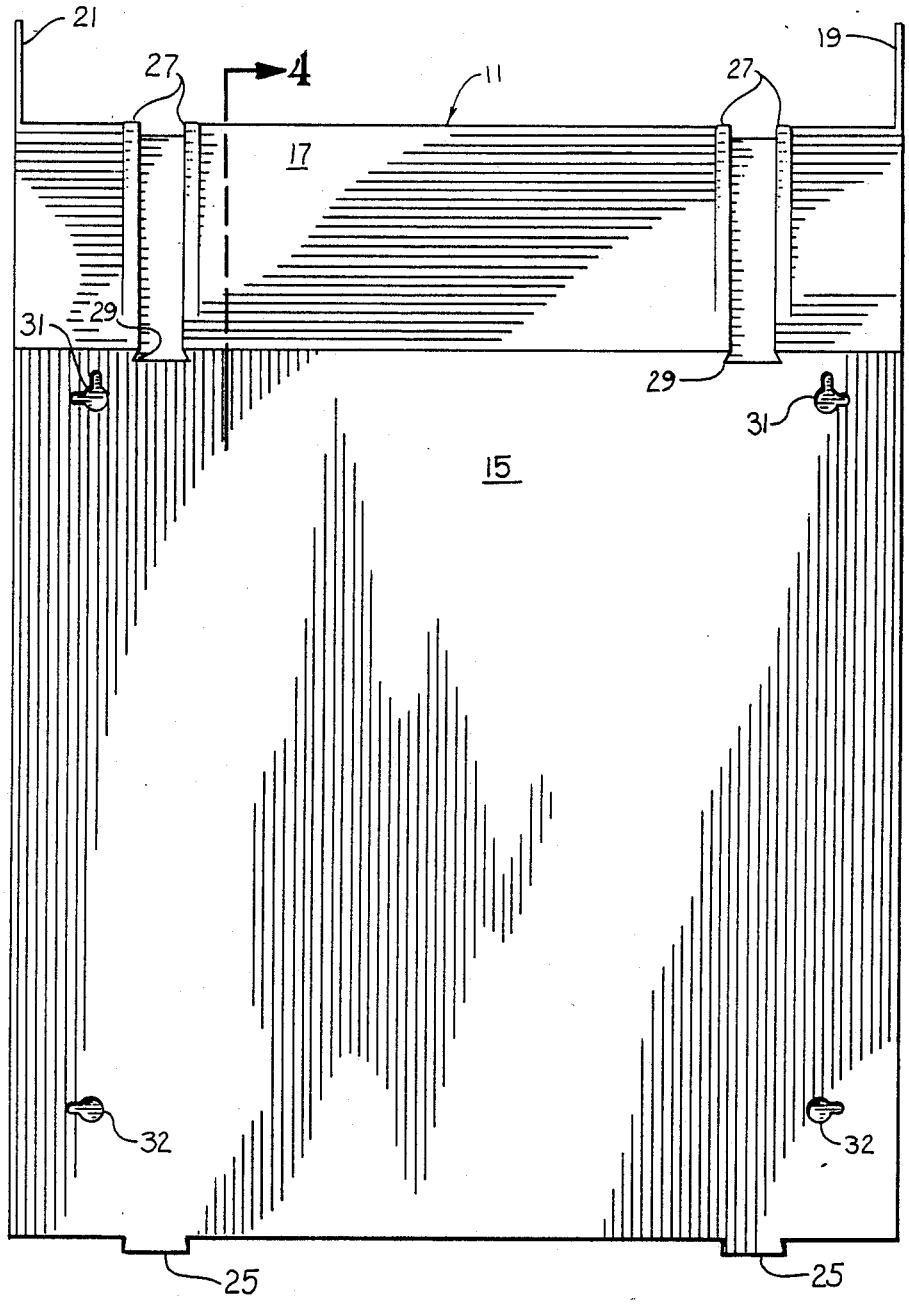
FIG. 3 is a rear elevational view thereof.

The back 15 of the rack 11 is provided with openings 31 and 32, preferably of keyhole shape, so that ticket rack modules 11 may be mounted vertically in any of three orientations (FIG. 3). The ticket rack modules 11 alternatively may be self-supporting when resting on side 19 or side 21, and clips, screws, or other fasteners may be provided to secure side 19 of one ticket rack module 11 to side 21 of an adjacent ticket rack module, if desired.

Rack module 11 has horizontal dividers 41, 42, 43, 44, and 45 which are generally parallel to bottom 13 and top 17, and in combination provide six separated rows for the retention of tickets. It will be understood that six is an arbitrary number, and a greater or lesser number of rows of openings could equally well be provided.

While the height of the ticket rack is divided into six segments by the horizontal dividers 41–45, the horizontal extent of the ticket rack is also separated into segments so that individual ticket holding pockets or compartments are formed. There is one central vertical divider 47 which is permanent, and as shown in FIG. 1, a number of movable divider inserts 65 are retained in slotted track elements 61. Slotted tracks 61 are integrally formed on the top and bottom of each of the dividers 41, 42, 43, 44, and 45, and are also formed on the bottom of top 17 and the top of bottom 13.

Arranged as shown in FIG. 1 inserts 65 together with the permanent vertical divider 47 cause the horizontal extent of the ticket rack 11 to be divided into four substantially equal parts, with the result that there are twenty-four (six times four) ticket compartments adapted to hold tickets of approximately two and one-half inch width. The specific example illustrated is particularly adapted for holding and organizing tickets of either one and one-half inch width or of two and one-half inch width, these being common dimensions in current ticket printing practice. It will be appreciated that variations in the dimensions of the apparatus may be made to accommodate different widths of tickets without departing from the scope and intent of the invention.

Figure 4:
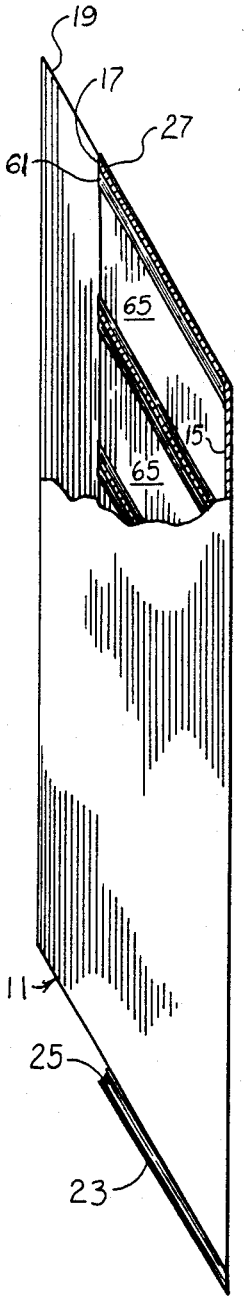
FIG. 4 is a side elevational view thereof partially broken away to show the interior and the placement of removable dividers therein.

The arrangement of divider inserts shown in FIG. 1 for ticket rack 11 is not well adapted for holding one and one-half inch tickets, and it will be understood that the divider inserts 65 may be removed from slotted tracks 61 and placed in slotted tracks 49 to adapt the ticket rack to one and one-half inch width tickets. Additional divider inserts would, of course, be required to accommodate the greater number of slotted tracks 49 arranged for one and one-half inch tickets. It may also be noted that the particular embodiment shown has slotted tracks 57 and 59 which are slightly displaced by the presence of connector elements 27 and may require divider inserts (not shown) of slightly different dimensions than the dimensions of the standard divider inserts 65. The location of divider inserts 65 in place in slotted tracks 61 may be seen most clearly in FIG. 4.

The method of use of the modular ticket rack apparatus is believed to be apparent from the foregoing description, but more specifically one would determine the number of individual ticket compartments of a particular size, such as one and one-half inches, that would be desired to facilitate selection of tickets for desired seat locations. More particularly, one might wish to have an arrangement of a particular number of rows and a particular number of columns of such compartments. This would determine the number of modular ticket racks required to provide a given number of rows and a given number of columns with one ticket rack width or ticket rack height being required to provide either six rows or six columns, or any part thereof. The ticket racks may then be arranged with the openings facing upward or to the right or left, as desired, and the rack secured together by the use of connectors 23 and 27 on bottom 13 and top 17.

The racks may also be connected side-to-side if desired, and mounted, in most cases, with back 15 vertical and attached to a wall or other suitable support. If the modular ticket rack is to be converted for use with two and one-half inch tickets, or if it is originally to be set up for use with two and one-half inch tickets, the divider insert 65 will be located in slotted track 61 (as in FIG. 1) rather than in slotted tracks 49. A greater number of ticket rack modules 11 would be required to provide the same number of compartments in the case of two and one-half inch tickets.

It will be appreciated that the specific features of the apparatus shown are by way of illustration only and not to be considered to be of a limiting nature. For example, the connectors 23 and 27 which are of dovetail tongue and groove shape may be replaced by other connector arrangements, or the modular racks 11 may be individually supported without interconnection. Similarly the particular slotted track arrangement for retaining divider insert 65 may be replaced by other equivalent arrangements for removably securing divider 65. Also the number of compartments in a particular module either vertically or horizontally is clearly subject to variation.

In addition to the modifications and variations of the invention suggested or described above other variations and modifications will be apparent to those of ordinary skill in the art, and accordingly the scope of the invention is not to be considered limited to the particular embodiments shown, described, or suggested, but is rather to be determined by reference to the appended claims.

What is claimed is:

1. A compartmented holder for tickets or the like comprising a box structure adapted to be mounted vertically on a wall having an open front, two vertical sides, a vertical back, an obliquely oriented top and an obliquely oriented bottom generally parallel thereto, at least one permanent vertical divider in said structure, at least two integral horizontal dividers arranged substantially parallel to said top and said bottom, said horizontal dividers, said top, and said bottom having slotted tracks therein for receiving vertically disposed divider inserts in the space between each vertically adjacent pair of said horizontal dividers, there being at least two columns of slotted tracks for receiving divider inserts on each side of said center divider, and a plurality of divider inserts adapted to fit between vertically adjacent horizontal dividers in engagement with said slotted tracks to divide the horizontal extent of said box structure into at least four columns of compartments situated in at least four rows.

2. Apparatus as recited in claim 1 wherein said slotted tracks are located to retain divider inserts which divide the horizontal extent of said box structure into six approximately equal parts in cooperation with at least one permanent vertical divider.

3. Apparatus as recited in claim 2 further including a plurality of slotted tracks on said horizontal dividers located to retain divider inserts forming rows of four substantially equal compartments across the horizontal extent of said box structure in cooperation with said permanent vertical divider.

4. Apparatus as recited in claim 1 wherein said divider inserts have the shape of a parallelogram.

5. Apparatus as recited in claim 1 wherein said back has openings of keyhole shape for mounting it in a normal, vertical position, and additional openings of keyhole shape for mounting it in a rotated position with the compartments opening to the right or to the left.

6. Apparatus as recited in claim 1 wherein said top and bottom form an angle of less than 45° with said back.

7. A compartmented holder for tickets or the like comprising a molded plastic box structure adapted to be mounted vertically on a wall having an open front, two vertical sides, an obliquely oriented top and an obliquely oriented bottom generally parallel to said top, at least two permanent horizontal dividers arranged substantially parallel to said top and said bottom, said horizontal dividers having slotted tracks molded therein for receiving vertically disposed divider inserts in the space between each vertically adjacent pair of said horizontal dividers, there being at least eight slotted tracks for receiving respective divider inserts arranged in at least two vertical columns, connectors in the top and the bottom of said box structure to allow a pair of identical ones of such box structures to be joined together in modular fashion, and a plurality of divider inserts adapted to fit between vertically adjacent horizontal dividers in engagement with said slotted tracks to divide the horizontal extent of said box structure into at least three columns of compartments situated in at least four rows.

8. Apparatus as recited in claim 7 having an integral vertical divider and wherein said slotted tracks are located to retain divider inserts which divide the horizontal extent of said box structure into six approximately equal parts in cooperation with said integral vertical divider.

9. Apparatus as recited in claim 8 further including a plurality of slotted tracks on said horizontal dividers located to retain divider inserts forming rows of four substantially equal compartments across the horizontal extent of said box structure in cooperation with said integral vertical divider.

10. Apparatus as recited in claim 7 wherein said divider inserts are in the shape of a parallelogram.

11. Apparatus as recited in claim 7 wherein said top and bottom form an angle of less than 45° with said open front.

* * * * *

UNITED STATES PATENT AND TRADEMARK OFFICE

CERTIFICATE OF CORRECTION

PATENT NO. : 4,909,399

DATED : March 20, 1990

INVENTOR(S) : Julian R. Dyrhood; James D. Walcott, Jr.

It is certified that error appears in the above-identified patent and that said Letters Patent is hereby corrected as shown below:

On the title page:

Item [19] above the title delete "et al.".

Item [75] after the title, change the inventorship information to read -- Inventor: Julian R. Dyrhood, Fort Smith, Ark. --.

In Column 5, line 14 (claim 7) after "eight" insert -- pairs of --.

Signed and Sealed this

Fifth Day of November, 1991

*Attest:*

HARRY F. MANBECK, JR.

*Attesting Officer*

*Commissioner of Patents and Trademarks*